US006851550B2

(12) United States Patent
Bishop et al.

(10) Patent No.: US 6,851,550 B2
(45) Date of Patent: Feb. 8, 2005

(54) INFUSION PACKAGE

(75) Inventors: Oliver Bishop, Liss (GB); Illtyd Llewellyn Lewis, London (GB); Christopher Charles Russell, Farnham (GB); Philip Stankus, Coldwaltham (GB); Nicholas Smart, Littlehampton (GB)

(73) Assignee: Tea Projects Limited (GB)

( * ) Notice: Subject to any disclaimer, the term of this patent is extended or adjusted under 35 U.S.C. 154(b) by 145 days.

(21) Appl. No.: 10/378,950

(22) Filed: Mar. 5, 2003

(65) Prior Publication Data

US 2003/0185942 A1 Oct. 2, 2003

(30) Foreign Application Priority Data

Mar. 18, 2002 (GB) ..... 0206361
Aug. 29, 2002 (GB) ..... 0220073

(51) Int. Cl.[7] ..... B65D 85/00; B65D 75/00; B65D 29/02

(52) U.S. Cl. ..... 206/0.5; 206/804; 426/77

(58) Field of Search ..... 206/0.5, 495, 548, 206/784, 460–462, 804; 426/77–84

(56) References Cited

U.S. PATENT DOCUMENTS 2,101,225 A * 12/1937 Rambold ..... 206/0.5
2,614,934 A * 10/1952 Trotman ..... 426/83
2,698,082 A * 12/1954 Maloney ..... 426/77
3,175,911 A * 3/1965 Rambold ..... 426/83
3,431,569 A * 3/1969 Gerke ..... 206/0.5
3,899,599 A * 8/1975 Rambold ..... 206/0.5
4,290,521 A * 9/1981 Mitchell ..... 206/0.5
4,887,709 A * 12/1989 Shimamine ..... 206/495
6,454,096 B1 * 9/2002 Kondoh et al. ..... 206/494

* cited by examiner

*Primary Examiner*—Mickey Yu
*Assistant Examiner*—Gregory Pickett
(74) *Attorney, Agent, or Firm*—H. Jay Spiegel

(57) ABSTRACT

An improved infusion package serves both for the storage of an infusion bag prior to use and for the reception and secure retention of both the infusion bag and surplus infusion liquid after use. The infusion package is of the kind having an infusion bag housed within a container formed from folded panels of flat sheet material, the container including first and second panels joined at respective opposite parallel edges and held in an outwardly bowed convex or pillow shape by overlapping margins that are folded about concave lines extending between the parallel edges, one of said opposed panels having an opening and a third panel located relatively to the one panel by a hinge and closing the opening.

8 Claims, 7 Drawing Sheets

INFUSION PACKAGE

BACKGROUND OF THE INVENTION

This invention relates to an infusion package of the type including a porous bag for containing tea, coffee or other infusible particulate material.

In recent years, many attempts have been made to provide a commercially attractive disposable infusion package including an infusion bag such as a tea bag that is simple to manufacture, that enables convenient placement of the infusion bag in a cup or mug for preparation of a beverage, and that also enables disposal of the used infusion bag without inconvenient spillage of the residue of infusion liquid contained within the infusion bag and its contents after infusion.

The majority of currently available infusion packages that are in commercial use comprise either the simple tea bag that is supplied in multiple packs and simply dropped into a cup for infusion, or tea bags that are individually provided with means to assist removal from the cup after infusion. These can be contained in individual sealed envelopes which preserve the flavour or aroma of the tea.

Proposals have been made for an infusion package comprising a tea bag located within an enclosure that both serves for storage of the tea bag prior to use and for reception of the used tea bag after use. Such packages are adapted to remain externally of the cup during infusion, whilst supporting the tea bag during the infusion process. They then enable return of the tea bag to the enclosure for disposal thereof. Despite the variety of hitherto known proposals, however, none has yet achieved significant commercial success.

U.K. A-2,167,380 describes for example an infusion package comprising a cover having two foldable leaves with a tea bag attached to one leaf. The two leaves can be sealed together to form an enclosure for the tea bag prior to use. However, the package has the disadvantage that spillage of surplus liquid from the tea bag is not adequately prevented after use. It is necessary for the user to squeeze surplus liquid from the tea bag by engagement between the leaves before attempting disposal of the package without spillage. This not only requires an additional operation to be performed by the user, but also has the disadvantage that squeezing of surplus liquid from the tea bag into the prepared beverage may have a deleterious effect on the desired quality of the beverage.

There has also been proposed, see GB-A-2229991, an infusion package in the form of two closure members hinged together, one of said members supporting a tea bag. The arrangement is such that, when opened, the tea bag can be supported within a cup or mug for infusion of the beverage, whereas after infusion the tea bag can be returned to the enclosure, which forms a secure container retaining both the tea bag and any surplus infusion liquid prior to disposal. In this prior proposal, the container members are formed by moulding from impervious material, and the package has disadvantages both in manufacture, in the aesthetic appearance of the final infusion package, and the environmental impact of the material used.

SUMMARY OF THE INVENTION

It is accordingly an object of the present invention to provide an improved infusion package that serves both for the storage of an infusion bag prior to use and for the reception and secure retention of both the infusion bag and surplus infusion liquid, after use. The container should be both simple and inexpensive to manufacture, have an aesthetic appearance that is attractive to the user, and be made from renewable and substantially biodegradable materials.

In accordance with one aspect of the invention there is provided an infusion package of the kind comprising an infusion bag housed within a container formed from folded panels of card or like flat sheet material, said container including first and second panels joined at respective opposite parallel edges thereof and held in an outwardly bowed convex or pillow shape by overlapping margins that are folded about concave lines extending between said parallel edges, one of said opposed panels having an opening and a third panel located relatively to said one panel by a hinge and closing said opening, said infusion bag attached to an inner surface of said third panel and accommodated between said first and second panels and the arrangement being such that upon hingeing of said third panel to free said opening the infusion bag attached to said third panel can pass through said opening into a position such that with the container supported externally of a cup or mug, the infusion bag can be suspended within the latter for immersion in an infusion liquid.

In accordance with a further aspect of the invention the surface of the panel to which the infusion bag is attached may have lines of weakness defining a severable flap that can be formed by perforating the panel along lines of weakness. The flap can then be extended from said panel by folding about a hinge joining opposed lines of weakness. The hinged flap when intact, forms part of the closed container, and when folded along its hinge, it provides a means of suspending the infusion bag further away from the supporting panel when in its position of use.

An arrangement in accordance with the invention has the advantage that it can be formed simply from a blank of cardboard or like material, whilst providing secure storage both for the infusion bag and its contents prior to use, and for the used bag and surplus infusion liquid, after use.

Preferably the blank is formed in one piece.

Advantageously a portion of said third panel remote from said hinge is releasably attached to said second panel.

The third panel may be releasably attached by means of a peelable adhesive provided on an inner surface thereof. The third panel may also have a flap adapted to be folded over the second panel and provided internally with a peelable self-adhesive layer.

In an alternative arrangement at least one portion of said third panel may be divided from the remainder by at least one line of weakness and secured to said one panel whereby release of said third panel can be achieved by severing at least one portion along said at least one line of weakness. In this case, although the third panel may have a flap adapted to be folded over the second panel, there is no necessity to provide the flap with any self-adhesive layer and the flap may serve conveniently as a finger grip for use in severing the other container member along its lines of weakness.

DESCRIPTION OF THE DRAWINGS

The invention is illustrated by way of example in the accompanying drawings, in which.

SPECIFIC DESCRIPTION OF THE INVENTION

Figure 1:
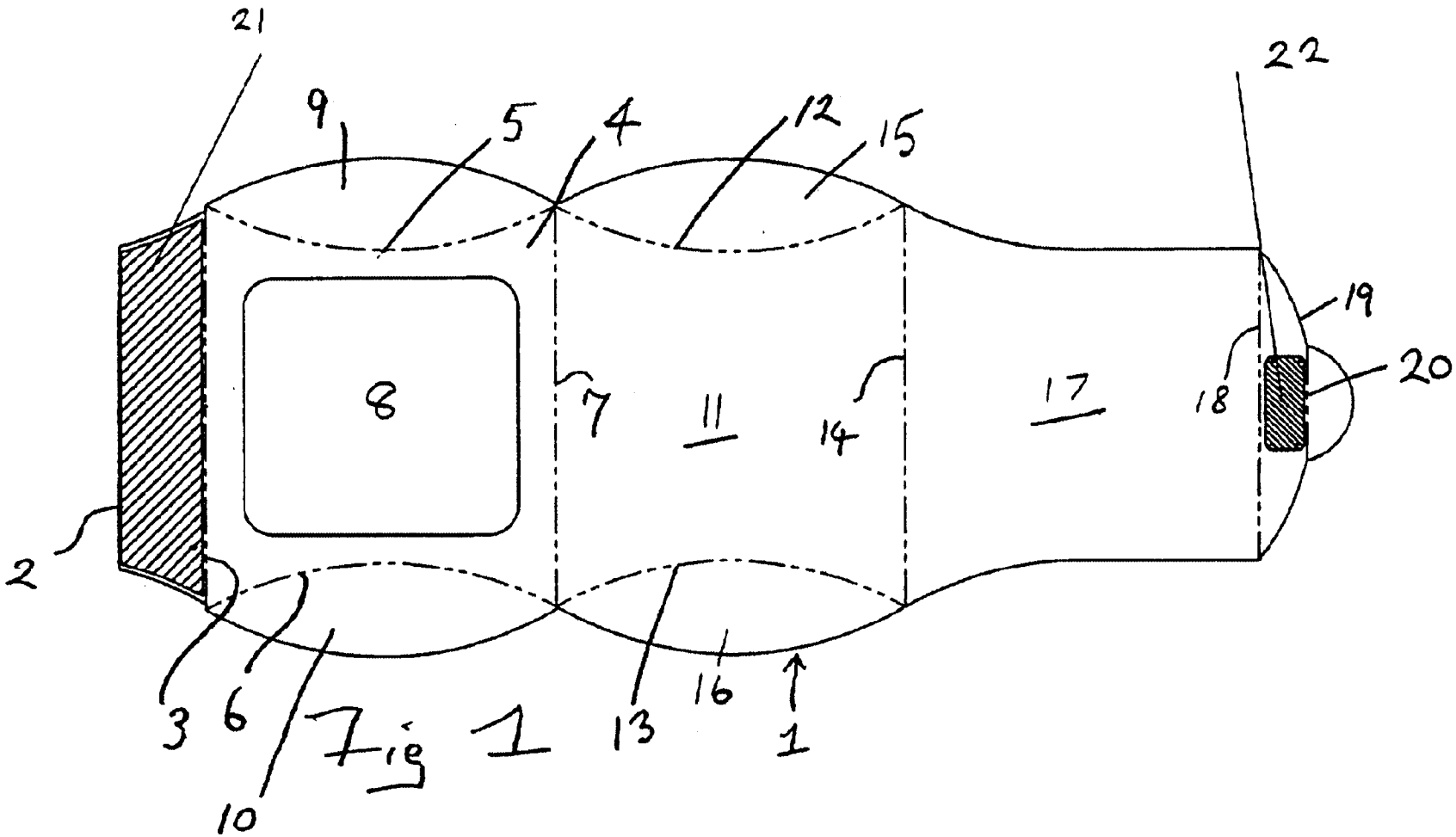
FIG. 1 is a plan view of a flat blank for use in the preparation of an infusion package.

Referring to FIG. 1 of the drawings, a flat blank generally indicated by the reference numeral 1 is formed in one piece from card or other similar foldable material and has the outline indicated in full lines, whilst being provided with fold lines indicated by the chain dotted lines shown in the drawing.

Thus the blank comprises a flap 2 defined by a fold line 3, a first panel 4 defined by the fold line 3 and fold lines 5, 6 and 7 and having a central aperture 8, flaps 9 and 10 forming bounding edges of the panel 4 and defined by the fold lines 5 and 6, a second panel 11 defined by the fold lines 7 and fold lines 12, 13 and 14, flaps 15 and 16 forming bounding edges of the panel 11 and defined by the fold lines 12 and 13, a third panel 17 defined by the fold line 14 and a further fold line 18, and a closure flap 19 incorporating a further fold line 20.

In use, the blank shown in FIG. 1 is formed into a container by providing a layer of adhesive 21 on the upper surface of the flap 2 as viewed in the drawing. The flap 2, and panels 4 and 11 are then folded away from one another along the fold lines 3 and 7, and the edges of the panels 4 and 11 represented by the fold lines 3 and 14 are brought to meet one another with the adhesive surface of the flap 2 secured against the lower surface of the panel 11 in the margin adjacent the fold line 14.

The flap 19 is provided with a peelable self-adhesive layer on its lower surface as viewed in the drawing as indicated at 22.

With the blank 1 in the form thus achieved, the blank forms a precursor of a package that may be stored in flat form ready for the insertion of an infusion bag such as a tea bag or like. In order to form the final package, an infusion bag is secured to the panel 17 on its underside as viewed in FIG. 1, an attachment being made in the region of the fold line 18. To complete the package, the flaps 9, 10, 15 and 16 re then folded along the fold lines 5, 6, 12 and 13, so that these flaps snap inwardly to overlie one another and support the panes 4 and 11 in an outwardly bowed convex form. The two panels 4 and 11, together with the edge flaps 9, 10, 15 and 16 thus form a pillow-shaped envelope accessible through the opening 8. The panel 17 is then folded along the fold line 14 so that the infusion package secured thereto passes through the opening 8 into the enclosure formed by the panels 4 and 11. The flap 19 is then folded upon the fold line 18 so that the self-adhesive area 22 engages the panel 11 in the region of the fold line 7. In this condition, the infusion bag is safely enclosed within the package for storage.

Figure 2:
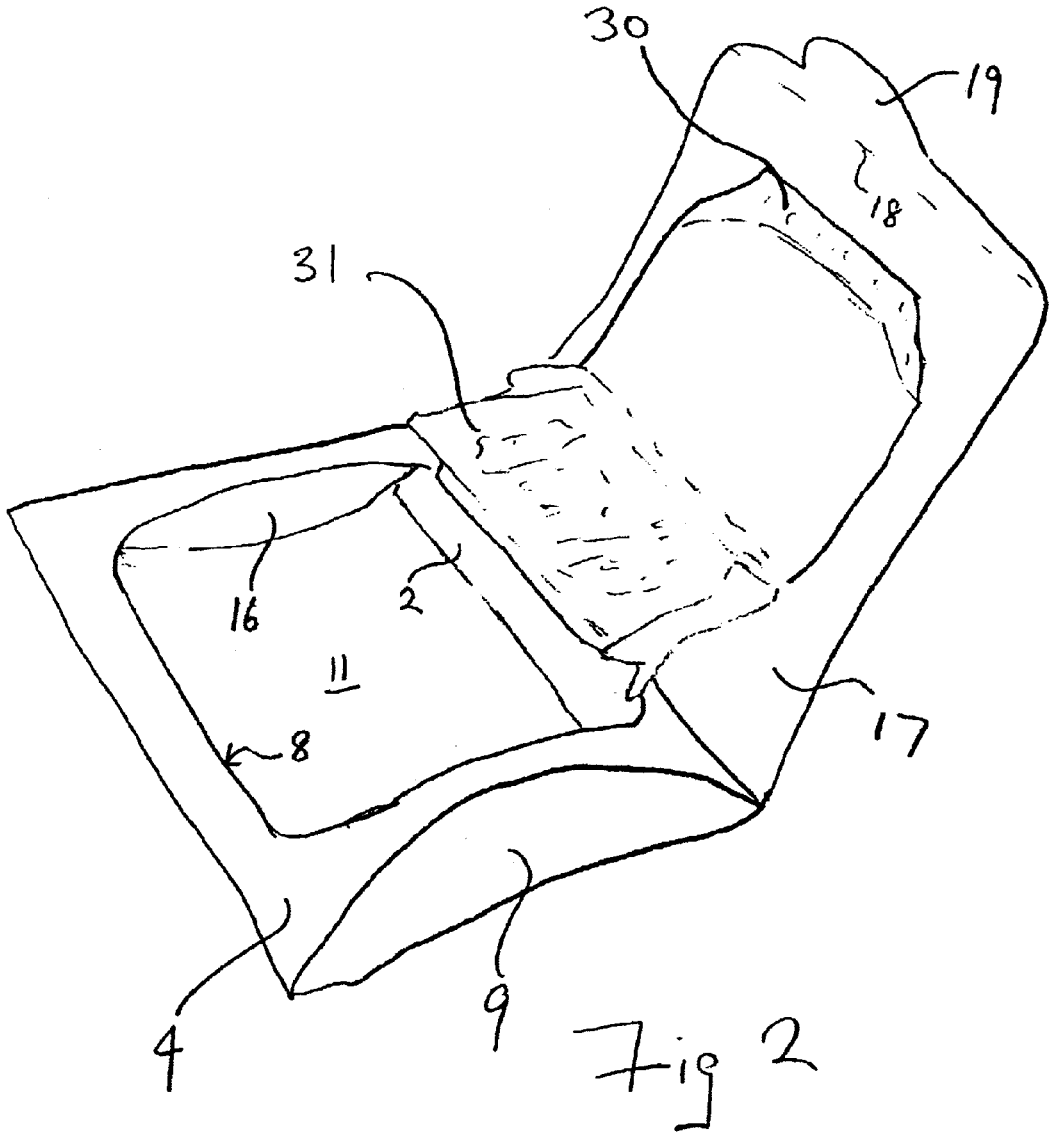
FIG. 2 is a perspective view of an infusion package formed from the blank shown in FIG. 1.

For use of the infusion bag, the free end of tab 19 defined by the fold line 20 is grasped by the user and the self-adhesive layer 22 is peeled from the panel 11 to bring the container into an open condition as shown diagrammatically in FIG. 2.

As shown in FIG. 2, in which like reference numerals illustrate the same parts of the package as shown in FIG. 1, a tea bag formed by a porous envelope has an upper edge 30 secured to the inside of the flap 17 and the body of the bag extends downwardly therefrom, the infusible contents of the bag being located within a lower region thereof identified by the reference numeral 31.

With the package in the open condition shown in FIG. 2, the lower portion 31 of the infusion bag is passed over the inside lip of a cup or mug, and the region of the bag containing the infusible contents is thus lowered into the cup or mug with the adjacent panels 4 and 17 passing downwardly on the outside of the lip of the cup or mug until the container is arrested with the lip of the cup or mug adjacent the region 30 of the bag that is attached to the panel 17.

After infusion of the contents of the bag 30, 31, the package is removed from the lip of the cup by lifting the flap 19 or holding the container by panel 9 and its mirror panel on the opposite side and the package naturally adopts an attitude such that the wet infusion bag and any infusion liquid dripping therefrom fall naturally through the aperture 8 into the enclosure formed by the panels 4 and 11. The fact that the panel 11 is bowed into an outwardly convex shape causes any surplus liquid to collect in a central area or trough defined by the panel 11 and the flaps 15 and 16, so that it becomes unnecessary for the edges of the enclosure defined by the flaps 9, 10, 15 and 16 to be sealed together.

The flap 17 is then again folded into the closed position and the flap 19 is resealed to the panel 11 to form a closed container that is convenient for disposal.

It will thus be seen that the arrangement according to the invention provides a very simple and convenient infusion package that is simple and inexpensive to manufacture, that is convenient for storage during the packing of the infusion bags in manufacture, and that securely encloses the used infusion bag for disposal after use.

It will be appreciated that various alterations and modifications may be made to the arrangement shown in the drawings without departing from the scope of the invention as defined by the appending claims. Thus, although it is unnecessary for the overlapping flaps 9, 10, 15 and 16 to be sealed together with adhesive, an adhesive could be used to seal the flaps together if desired. Furthermore, although the shape of the blank 1 and the fold lines 5, 6, 12 and 13 is such as to form a cushion or pillow-shaped container it will be appreciated that flaps of a different shape could be adopted to form an alternative configuration in which the panels 4 and 11 are displaced away from one another. An alternative form of closure could also be adopted for retaining the panel 17 in the closed condition.

Referring to FIGS. 3 to 7 of the drawings there is shown a second embodiment of the invention, similar parts being indicated with the same reference numerals as shown in FIGS. 1 and 2, which will therefore not be described again in detail.

Figure 3:
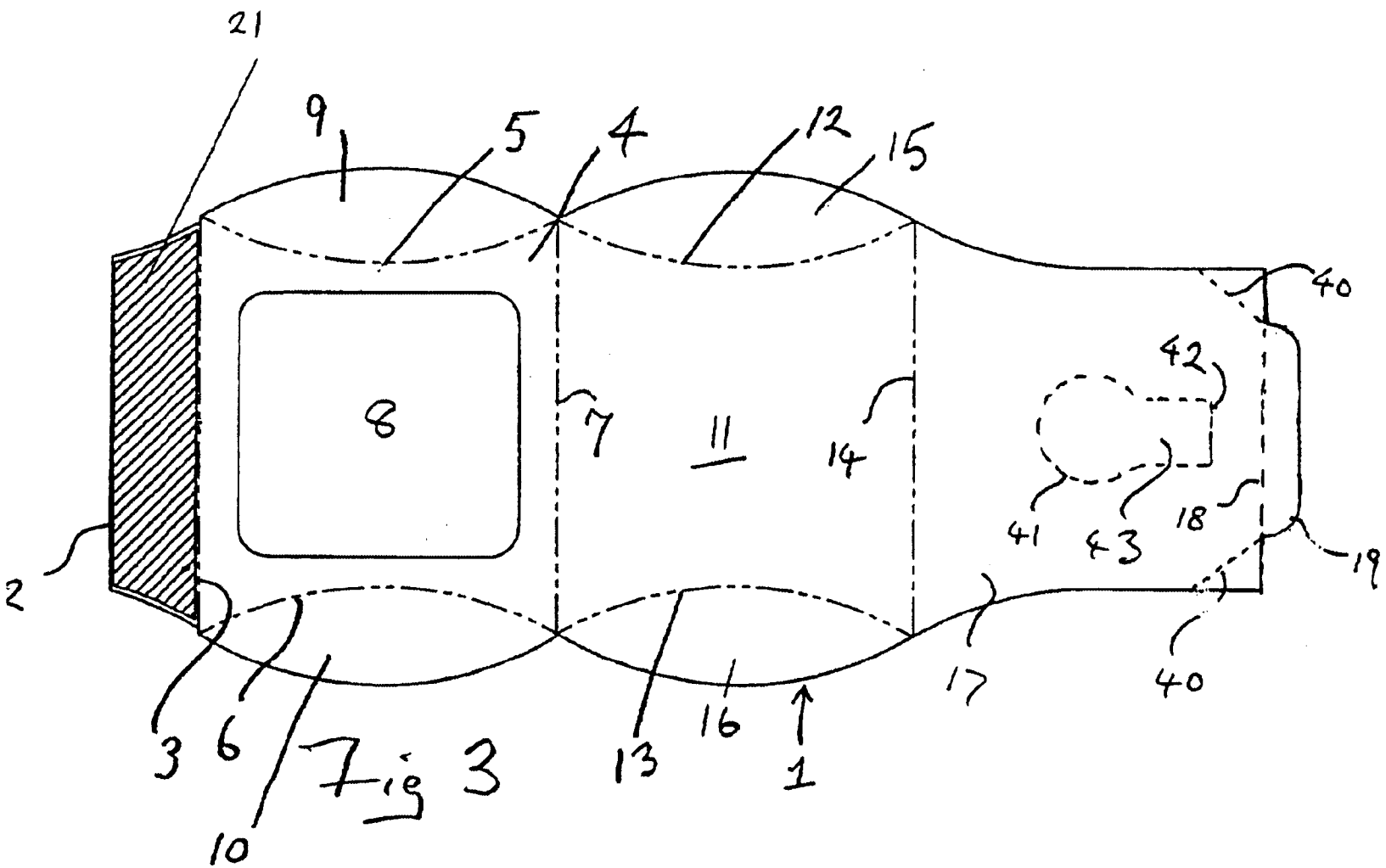
FIG. 3 is a view corresponding to FIG. 1 and showing an alternative embodiment of blank in accordance with a second embodiment of the invention.

Referring to FIG. 3, it will be seen that the blank of the second embodiment differs from that of FIG. 1 in that the free end of the tab 19 defined by the fold line 20 of FIG. 1 is omitted together with the self-adhesive layer 22. The tab 19 is also slightly shortened, and two opposite corners of the flap 17 are provided with lines of weakness 40. The flap 17 is also provided with lines of weakness 41 and an embossed hinged line 42 defining a keyhole shaped flap 43 that can be severed from the panel 17 and folded about the hinge line 42. In this embodiment, the upper edge 30 of the tea bag is secured to the wider portion of the flap 43 and, when the bag is folded to form the closed container shown in FIG. 4, the container is held in the closed position by glueing the two opposed corners of the panel 17 to corresponding corners of the panel 4. The tab 19 is folded over the edge of panel 11, in a similar manner to the first embodiment, although it is not necessary for the tab 19 to be secured in place. Alternatively the fold line 18 may be omitted and the tab 19 may project beyond the edge of panel 11 so that its free end is easily accessible as a finger grip.

Figure 4:
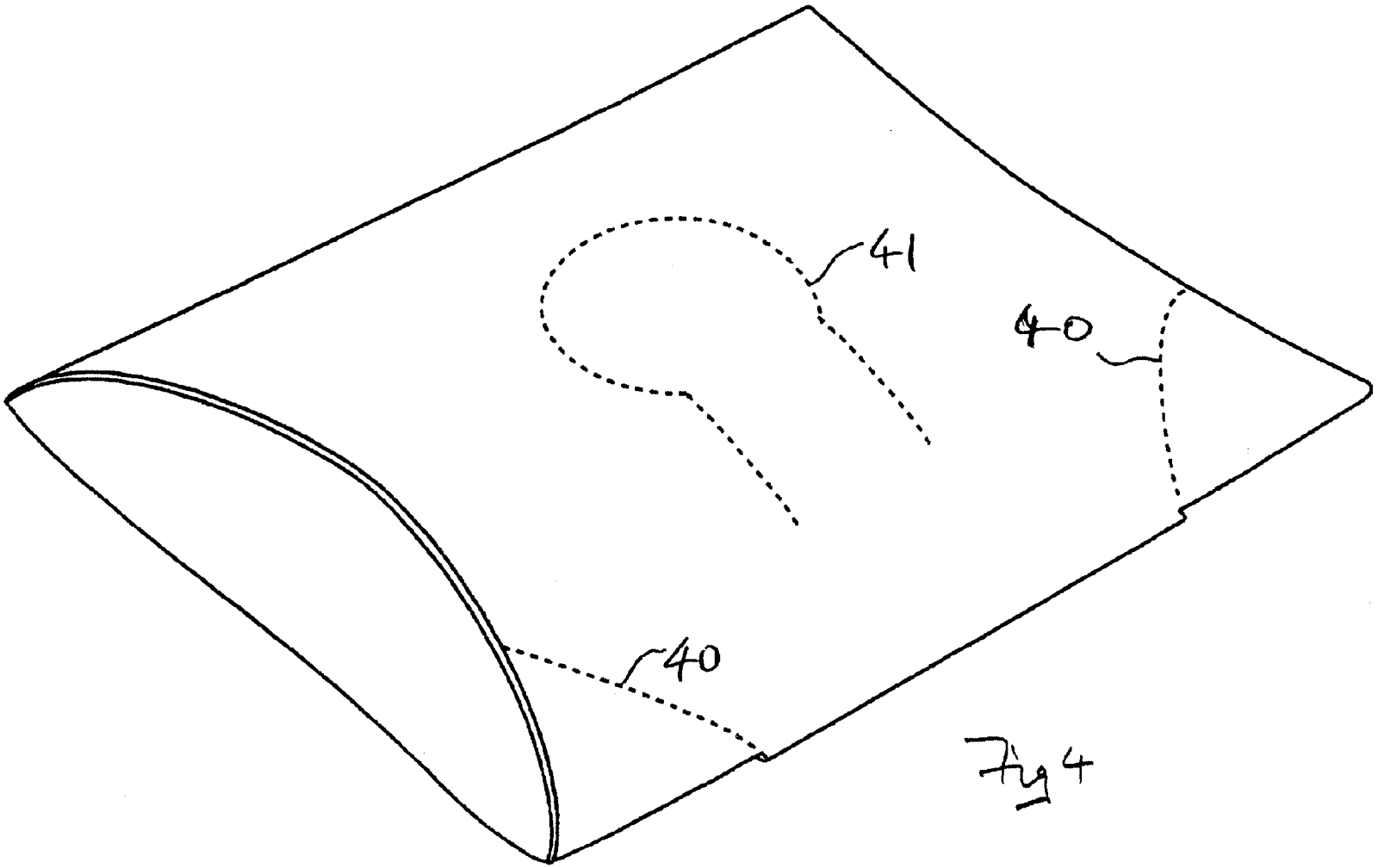
FIG. 4 is a perspective view of a closed container formed from the blank of FIG. 3.
Figure 5:
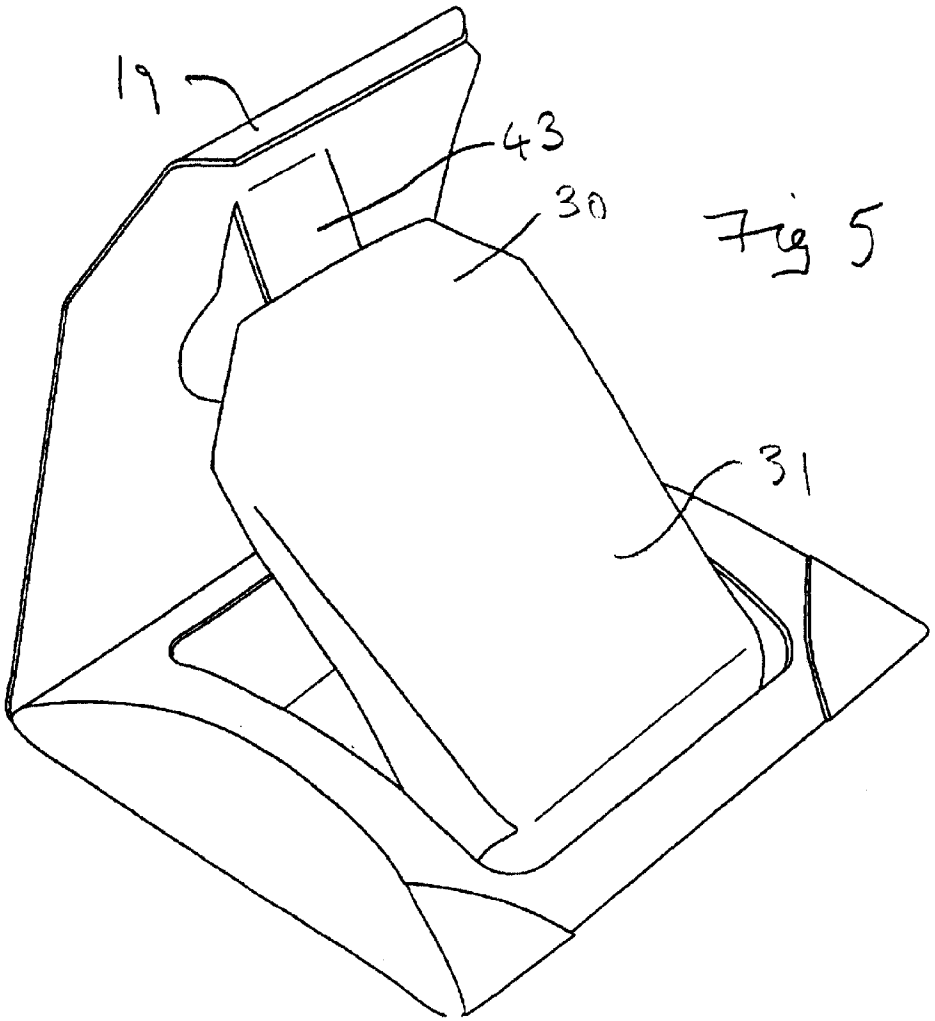
FIG. 5 is a perspective view showing the container of FIG. 4 during opening and prior to use.
Figure 6:
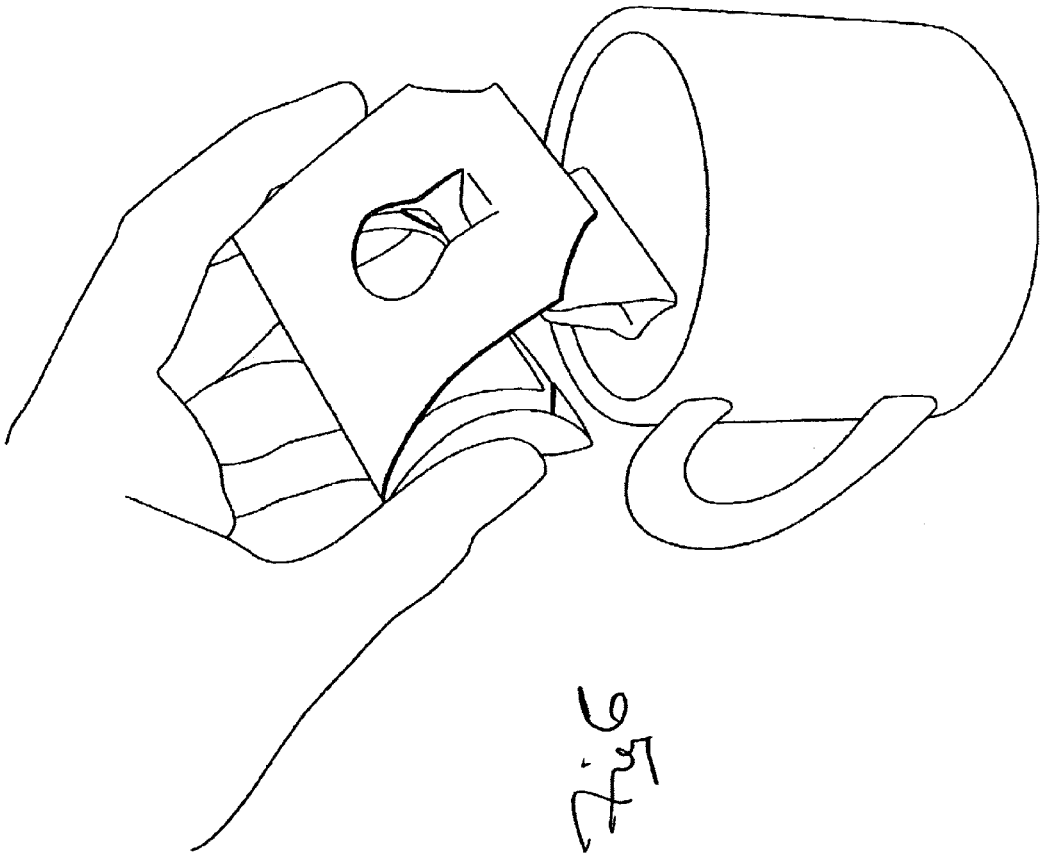
FIG. 6 is a perspective view showing the infusion package in its condition of use during arrangement over the lip of a cup to contain a infusion beverage.

In use, the infusion package is opened from the condition shown in FIG. 4 by pulling upon the tab 19 to cause the panel 17 to be severed along the lines of weakness 40 enabling the flap 17 to be opened. The flap 43 is then pushed inwardly and severed along the lines of weakness 41 so that it hinges along the line 42 into the position shown in FIG. 5. With the tea bag removed from the container the panels can be arranged over the lip of a cup or mug in the manner shown in FIG. 6, the folded flap 43 allowing the tea bag to descend downwardly into the infusion liquid. The presence of the flap 43 is of particular advantage in allowing total immersion of the tea bag in the brewing liquor, thus ensuring optimum infusion without the need for an additional suspension device between the panels and the tea bag. It will be appreciated therefore that the embodiment of FIGS. 1 and 2 would also be improved by the provision of such a flap 43 in the panel 17, for this purpose.

Figure 7:
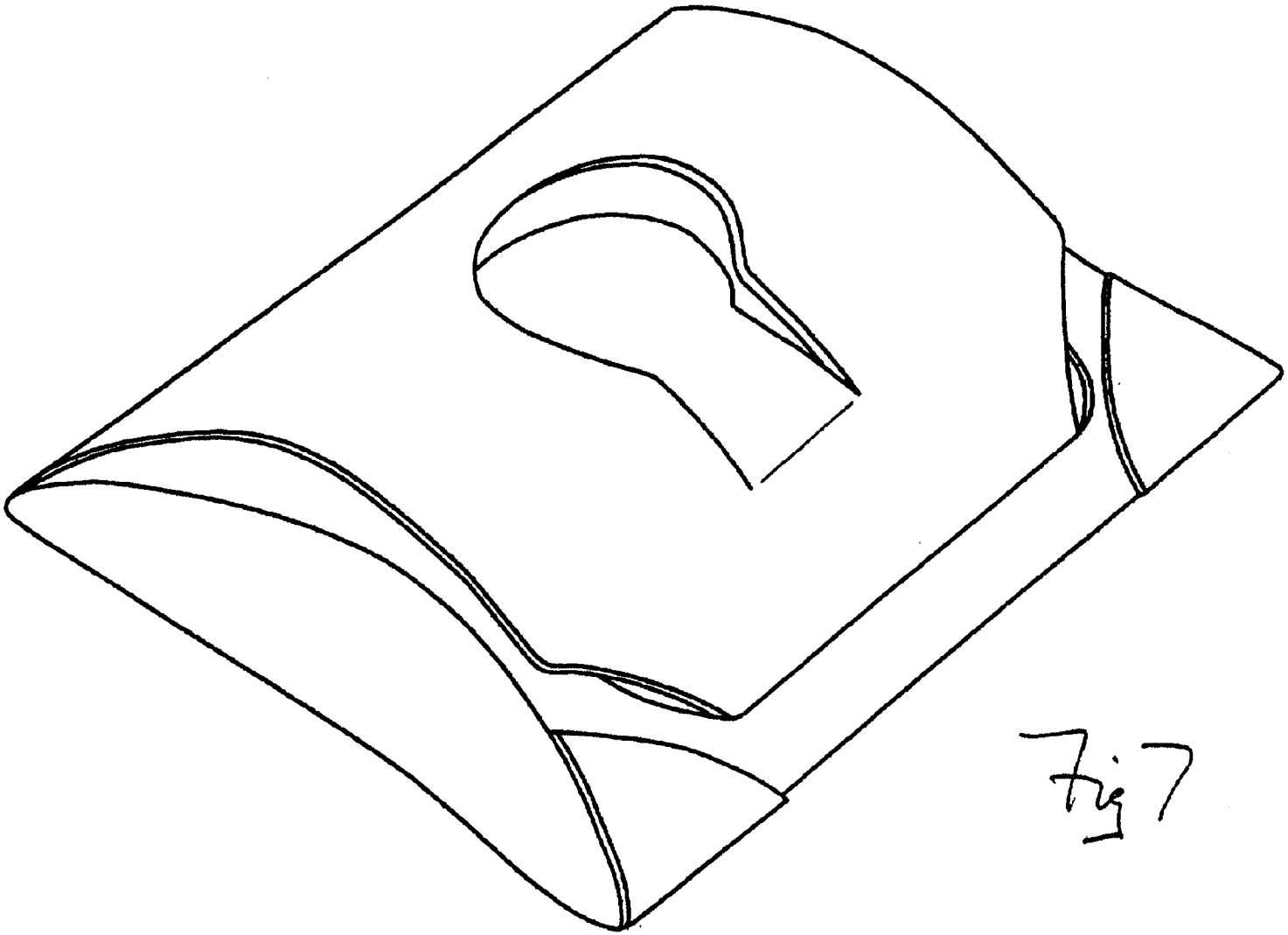
FIG. 7 is a perspective view showing the used container when reclosed for disposal.

After infusion, the tea bag can be returned into the container, which is then retained in the closed position for disposal, by insertion of the free end of the panel 17 into the opening 8, in the manner shown in FIG. 7.

What is claimed is:

1. An infusion package comprising an infusion bag housed within a container formed from folded panels of card or like flat sheet material, said container including first and second panels joined at respective opposite parallel edges thereof and held in an outwardly bowed convex or pillow shape by overlapping margins that are folded about concave lines extending between said parallel edges, one of said opposed panels having an opening and a third panel located relatively to said one panel by a hinge and closing said opening, said infusion bag attached to an inner surface of said third panel and accommodated between said first and second panels and the arrangement being such that upon hinging of said third panel to free said opening the infusion bag attached to said third panel can pass through said opening into a position such that with the container supported externally of a cup or mug, the infusion bag can be suspended within the latter for immersion in an infusion liquid.

2. A package according to claim 1 wherein a portion of said third panel remote from said hinge is releasably attached to said second panel.

3. A package according to claim 2 wherein at least one portion of said third panel is divided from the remainder by at least one line of weakness and is secured to said one panel, whereby release of said third panel can be achieved by severing at least one portion along said at least one line of weakness.

4. A package according to claim 2 wherein said third panel is releasably attached by means of a peelable adhesive provided on an inner surface thereof.

5. An infusion package according to claim 1, wherein said infusion bag is attached to a portion of said third panel bounded by lines of weakness to form a severable flap from which the infusion bag can be suspended when in use.

6. A package according to claim 5 wherein a portion of said third panel remote from said hinge is releasably attached to said second panel.

7. A package according to claim 5 wherein at least one portion of said third panel is divided from the remainder by at least one line of weakness and is secured to said one panel, whereby release of said third panel can be achieved by severing at least one portion along said at least one line of weakness.

8. A package according to claim 6 wherein said third panel is releasably attached by means of a peelable adhesive provided on an inner surface thereof.

* * * * *